United States Patent [19]

Suzuki et al.

[11] 4,304,269

[45] Dec. 8, 1981

[54] WEFT GUIDING COMB FOR A JET LOOM

[75] Inventors: Hajime Suzuki, Anjyo; Yoshifumi Umemura, Toyoake; Masahiko Kimbara, Kariya; Yoshimi Iwano, Ohbu, all of Japan

[73] Assignee: Kabushiki Kaisha Toyoda Jidoshokki Seisakusho, Kariya, Japan

[21] Appl. No.: 129,412

[22] Filed: Mar. 11, 1980

[30] Foreign Application Priority Data

Mar. 15, 1979 [JP] Japan ..... 54-30170

[51] Int. Cl.[3] ..... D03D 47/30

[52] U.S. Cl. ..... 139/435

[58] Field of Search ..... 139/435; 226/97

[56] References Cited

FOREIGN PATENT DOCUMENTS 2332914 2/1975 Fed. Rep. of Germany ..... 139/435

2438754 2/1976 Fed. Rep. of Germany ..... 139/435

*Primary Examiner*—Henry Jaudon

*Attorney, Agent, or Firm*—Haseltine and Lake

[57] ABSTRACT

Generally, a weft guiding comb for a jet loom constructed in accordance with this invention comprises a root portion, an annular portion integrally connected to the upper end of the root portion and forming an aperture with a slit to allow a weft yarn passed through the aperture to come out of the latter, a fluid passage formed in each of said root and annular portions to allow a flow of fluid to flow therethrough, and a fluid outlet or outlets arranged around the periphery of the aperture for discharging the flow of fluid passed through the fluid passages. The weft guiding comb further comprises a relatively long and narrow fluid path or paths disposed between the fluid passage formed in the annular portion and the fluid outlet or outlets for orienting the flow of fluid, passed through said fluid passage in said annular portion, in a predetermined direction.

5 Claims, 6 Drawing Figures

WEFT GUIDING COMB FOR A JET LOOM

BACKGROUND OF THE INVENTION

This invention relates to a jet loom, in which weft yarns are inserted into the shed by a jet of fluid, and more particularly to combs with apertures for guiding the insertion of the weft yarns.

In the jet loom of the type described above, in addition to a main nozzle positioned in alignment with the apertures of the combs, a suitable number of sub-nozzles are generally employed to assist the yarn in being fed through the shed. For example, U.S. Pat. No. 3,139,118 discloses a weft guiding comb having the functions of the above-described sub-nozzle, which comb comprises two flattened tubes and an inlay connected thereto, the tubes having air discharge openings to supply air therethrough into the space of the aperture. However, in such a weft guiding comb, it is very difficult to form the discharge openings in the tubes so as to distribute the air, discharged from the openings, evenly around the jet of air produced by the main nozzle. This may result in a failure of the weft insertion.

It is therefore a principal object of this invention to provide a weft guiding comb having fluid discharging openings or outlets, each of which can produce a jet of fluid oriented in a direction assuring prevention of the escape of a weft yarn, being fed into a comb's aperture by the jet of fluid produced by the main nozzle, from the comb's aperture.

SUMMARY OF THE INVENTION

Generally, a weft guiding comb for a jet loom constructed in accordance with this invention comprises a root portion, an annular portion integrally connected to the upper end of the root portion and forming an aperture with a slit to allow a weft yarn passed through the aperture to come out of the latter, a fluid passage formed in each of said root and annular portions to allow a flow of fluid to flow therethrough, and a fluid outlet or outlets arranged around the periphery of the aperture for discharging the flow of fluid passed through the fluid passages. The weft guiding comb further comprises a relatively long and narrow fluid path or paths disposed between the fluid passage formed in the annular portion and the fluid outlet or outlets for orienting the flow of fluid, passed through said fluid passage in said annular portion, in a predetermined direction.

BRIEF DESCRIPTION OF THE DRAWINGS

This invention will become more readily apparent from the following description of the preferred embodiments shown, by way of example only, in the accompanying drawings, wherein.

DESCRIPTION OF THE PREFERRED EMBODIMENTS

Figure 1:
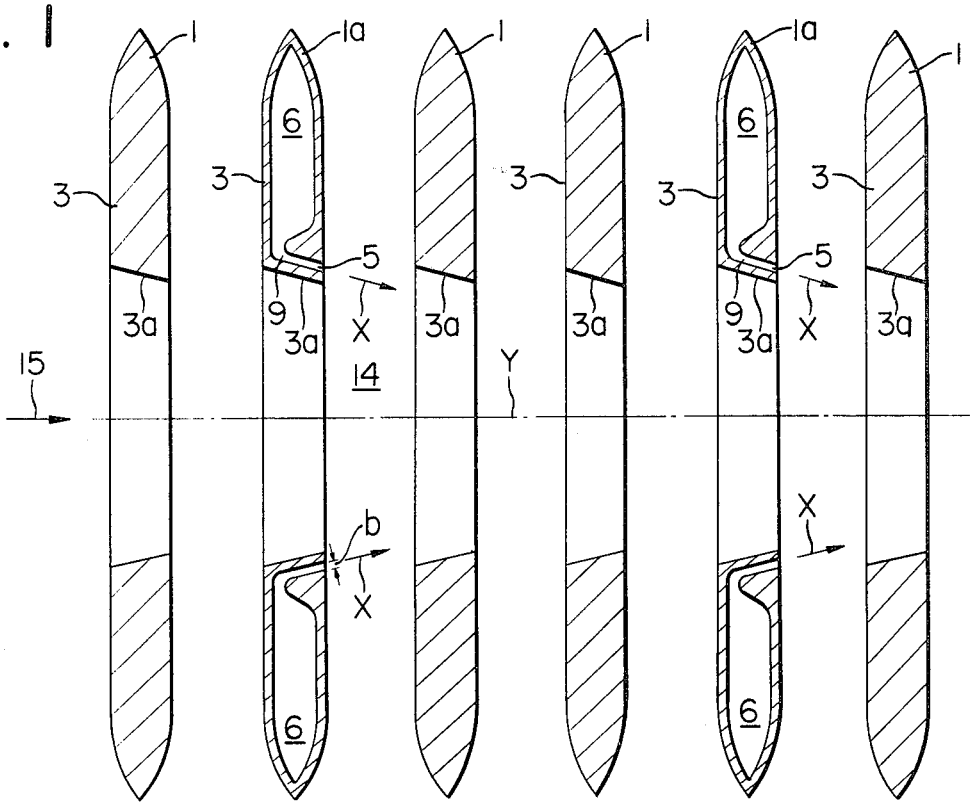
FIG. 1 is a plan view, in cross-section of an array of weft guiding combs including those formed according to this invention.

Referring to FIG. 1, there is shown an array of weft guiding combs 1 and 1*a* arranged in parallel to a not shown reed of a jet loom to form a continuous channel 14, through which a weft yarn is passed during the picking in a direction shown by the arrow 15.

Figure 2:
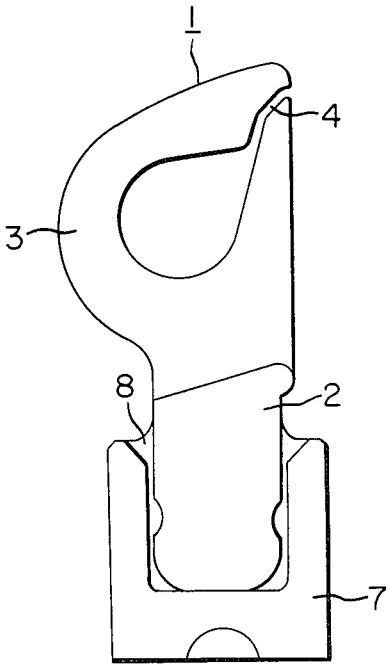
FIG. 2 is a side elevational view of the conventional weft guiding comb shown in FIG. 1.

As shown in FIG. 2, each of the guiding combs 1 consists of a straight root portion 2, which may be fixedly fitted into a U-shaped support 7 through a suitable adhesive 8, and an annular portion 3 projecting upwardly from the upper end of the root portion 2. The annular portion 3 defines an aperture 3*a* constituting the channel 14 (FIG. 1) and has a slit 4 formed in the upper part thereof to allow the weft yarn passed through the channel 14 to come out of the aperture 3*a* prior to the beating. Each weft guiding aperture 3*a* is converged toward the adjacent comb downstream of the weft inserting direction 15.

In suitable positions, weft guiding combs 1*a* constructed in accordance with this invention are interposed between the above-described combs 1 in alignment therewith. The comb 1*a* may be formed by a lost wax process or by a resin moulding.

Figure 3:
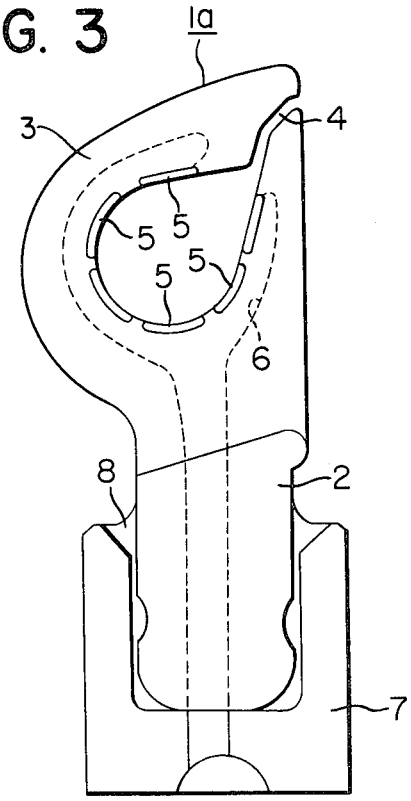
FIG. 3 is a side elevational view of the weft guiding comb constructed in accordance with this invention and shown in FIG. 1.

As shown in FIGS. 1 and 3, each of the guide combs 1*a* includes a plurality of fluid outlets 5 arranged around the downstream side of the aperture 3*a* so as to open into the channel 14. To supply the fluid to these outlets 5, a fluid passage 6 is provided in the root portion 2 and annular portion 3 of the comb 1*a* so as to be in fluid communication with the outlets 5. Although each of the outlets 5 is preferably arcuated as shown in FIG. 3, it may be formed in a circle. In addition, the arcuated outlets 5 may be connected together to form a single outlet extending along the majority of the inner peripheral edge of the annular portion 3.

According to this invention, the fluid passage 6 in the annular portion 3 is adapted to communicate through relatively narrow and long fluid orienting paths 9 with the respective fluid outlets 5 in order to orient the jet X of fluid, discharged through each of the outlets 5, in a preferred direction as shown in FIG. 1. The length of each fluid orienting path 9 is preferably two or more times the width b of the outlet 5.

With the weft guiding comb 1*a* formed as above, the jets X of fluid discharged through the outlets 5 can evenly surround the main jet (its center is shown by the reference letter Y in FIG. 1) produced by the not shown main nozzle. Thus, it is understood that the jets X can prevent deviation of the weft yarn, being fed through the channel 14, from the right path thereof in the channel 14. In particular, since the fluid orienting path 9 has the considerable length two or more times the width b of the outlet 5, it gives an improved directivity to the fluid jet X discharged through the corresponding fluid outlet 5. This eliminates any possible disturbance of the fluid jets X around the main fluid jet Y, allowing the fluid jets X to flow over a longer distance. Therefore, the array of weft guiding combs 1 and 1*a* assures a more reliable weft insertion.

Figure 4:
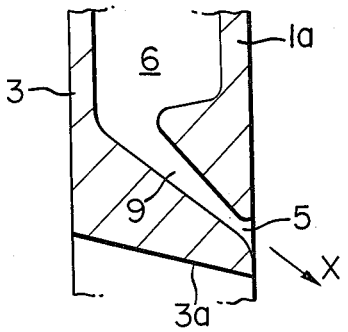
FIGS. 4 to 6 are sectional views showing different modifications of this invention.
Figure 5:
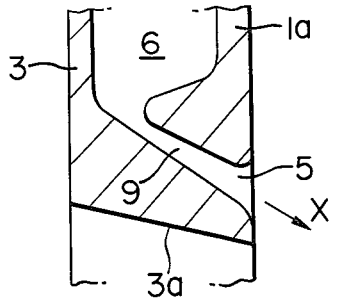

Although the fluid orienting path 9 shown in FIG. 1 is defined by substantially parallel surfaces, it may be of a configuration converging or diverging toward the corresponding fluid outlet 5 as shown in FIG. 4 or 5. In this case, the velocity of the fluid jet X at the outlet 5 can be increased and the directivity thereof can be further improved, thus allowing the fluid jets X to more effectively assist the main fluid jet Y in inserting the weft yarn into the channel 14.

Figure 6:
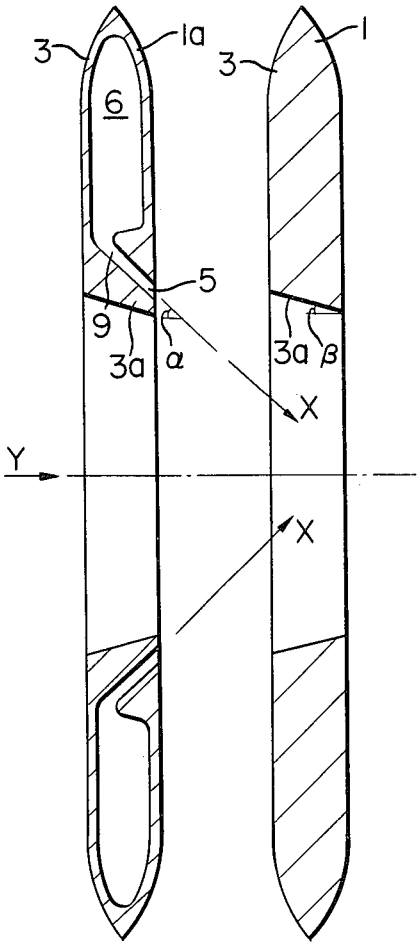

In the embodiment shown in FIG. 6, the fluid orienting path 9 has not only the considerable length discussed above, but also forms a larger angle $\alpha$ with respect to the center of the main fluid jet Y than an angle $\beta$ formed by the converging surface of the aperture 3*a* in the adjacent weft guiding comb 1. Thus, the fluid jet X is blown toward the center of the main fluid jet Y at the angle $\alpha$.

With the weft guiding comb 1*a* shown in FIG. 6, since the fluid orienting path 9 is inclined at the angle $\alpha$ larger than the angle $\beta$ of the converging aperture 3*a* in the downstream weft guiding comb 1, the fluid jet X discharged therethrough can be prevented from blowing against the surface of the aperture 3*a* in the downstream comb 1, but caused to blow directly against the weft yarn being fed through the channel 14. This allows the fluid jet X to have an effect on the weft yarn as soon as possible after it has been discharged through the corresponding fluid outlet 5, resulting in a more effective insertion of the weft yarn.

In addition, it will be understood that by blowing the fluid jet X directly against the weft yarn a discharge pressure of the fluid jet X and accordingly consumption thereof can be reduced.

Although various specific embodiments have been described above, it will be readily understood by those skilled in the art that various modifications may be accomplished without departing from the spirit and scope of the invention as defined in the apended claims. For example, the weft guiding comb 1*a* may comprise two members each extending along the overall length of the comb 1*a* and connected together by such means as welding, brazing, soldering or caulking.

What we claim is:

1. In a weft guiding comb for a jet loom comprising a root portion, an annular portion integrally connected to the upper end of the root portion and forming an aperture with a slit to allow a weft yarn passed through the aperture to come out of the latter, a fluid passage formed in each of said root and annular portions to allow a flow of fluid to flow therethrough, and outlet means arranged around the periphery of the aperture for discharing the flow of fluid passed through the fluid passage: the improvement comprising said outlet means being comprised by axially relatively long and narrow passage means of elongate transverse cross-section extending from said fluid passage in said annular portion and which orient the flow of fluid therethrough in a predetermined direction.

2. The weft guiding comb according to claim 1, wherein said outlet means comprising a plurality of arcuated slits arranged around the periphery of the aperture, and which in combination extend throughout substantially the entire circumference thereof.

3. The weft guiding comb according to claim 2, wherein said orienting means comprises a plurality of fluid paths each having an arcuated rectangular cross-section substantially homologous to the contour of the arcuated slit, and each fluid path has a length, along which the fluid passes, two or more times the width of the arcuated slit in the radial direction of said annular portion.

4. The weft guiding comb according to claim 3, wherein each fluid path is defined by radially inner and outer non-parallel planes converging together toward the arcuated slit.

5. The weft guiding comb according to claim 1, wherein said relatively long and narrow orienting means is inclined with respect to the center of the aperture at an angle larger than an angle at which a peripheral surface of the aperture is inclined with respect to the center thereof.

* * * * *